US011339707B2

(12) United States Patent
Wichers et al.

(10) Patent No.: US 11,339,707 B2
(45) Date of Patent: May 24, 2022

(54) FAN ASSEMBLY FOR A MOTOR VEHICLE

(71) Applicant: Brose Fahrzeugteile SE & Co. Kommanditgesellschaft, Würzburg, Würzburg (DE)

(72) Inventors: Marco Wichers, Bad Zwischenahn (DE); Thomas Dreesen, Oldenburg (DE)

(73) Assignee: Brose Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 0 days.

(21) Appl. No.: 17/292,018

(22) PCT Filed: Nov. 6, 2019

(86) PCT No.: PCT/EP2019/080310
§ 371 (c)(1),
(2) Date: May 7, 2021

(87) PCT Pub. No.: WO2020/094676
PCT Pub. Date: May 14, 2020

(65) Prior Publication Data

US 2022/0003144 A1 Jan. 6, 2022

(30) Foreign Application Priority Data

Nov. 7, 2018 (DE) ..... 10 2018 219 006.2

(51) Int. Cl.
*F01P 5/02* (2006.01)
*F01P 5/06* (2006.01)
(Continued)

(52) U.S. Cl.
CPC *F01P 5/04* (2013.01); *F01P 5/06* (2013.01); *F01P 7/08* (2013.01); *F04D 17/16* (2013.01);
(Continued)

(58) Field of Classification Search
CPC ..... F01P 5/06; F01P 11/10; F01P 5/02; F01P 1/06; F01P 2070/50; F01D 25/12; F01D 17/162
See application file for complete search history.

(56) References Cited

U.S. PATENT DOCUMENTS 5,649,587 A * 7/1997 Plant ..... F01P 5/06 123/41.49
5,845,612 A 12/1998 Lakerdas et al.
(Continued)

FOREIGN PATENT DOCUMENTS

DE 69620912 T2 11/2002
DE 20211857 U1 12/2003
(Continued)

*Primary Examiner* — Long T Tran
(74) *Attorney, Agent, or Firm* — Brooks Kushman P.C.

(57) ABSTRACT

A fan assembly including a first cooling fan arranged with respect to an air flow direction downstream of a heat exchanger and a second cooling fan. The first cooling fan is a radial fan that draws cooling air axially and expels the cooling air radially and the second cooling fan is an axial fan that draws cooling air axially and expels the cooling air axially. The axial fan is arranged downstream of the heat exchanger and laterally adjacent to the radial fan in a plane parallel to the rear side of the heat exchanger in a plane parallel to the front side of the heat exchanger.

20 Claims, 3 Drawing Sheets

(51) Int. Cl.

| | |
|---|---|
| ***F01P 5/04*** | (2006.01) |
| ***F01P 7/08*** | (2006.01) |
| ***F04D 17/16*** | (2006.01) |
| ***F04D 19/00*** | (2006.01) |
| ***F04D 25/16*** | (2006.01) |

(52) U.S. Cl.
CPC ..... *F04D 19/002* (2013.01); *F04D 25/166* (2013.01); *F01P 2005/025* (2013.01); *F01P 2005/046* (2013.01)

(56) References Cited

U.S. PATENT DOCUMENTS 6,155,335 A * 12/2000 Acre ..... B60K 11/04 123/41.56
2003/0026699 A1* 2/2003 Stairs ..... F04D 29/384 416/192
2004/0020449 A1* 2/2004 Stevens ..... F04D 29/386 123/41.49
2007/0264122 A1* 11/2007 Iwasaki ..... F04D 19/007 416/120
2008/0038111 A1* 2/2008 Iwasaki ..... F04D 25/06 415/198.1
2009/0129918 A1* 5/2009 Takeuchi ..... F04D 25/166 415/199.4
2009/0175745 A1* 7/2009 Usami ..... F04D 19/024 417/426
2015/0210156 A1* 7/2015 Manubolu ..... B60K 11/02 180/68.1
2018/0003101 A1* 1/2018 Kondou ..... B60K 11/04

FOREIGN PATENT DOCUMENTS

DE 102004028697 A1 1/2005
DE 602004000114 T2 7/2006
DE 102013006499 A1 10/2014
DE 102014226346 A1 6/2016

* cited by examiner

FAN ASSEMBLY FOR A MOTOR VEHICLE

CROSS-REFERENCE TO RELATED APPLICATIONS

This application is the U.S. National Phase of PCT Application No. PCT/EP2019/080310 filed on Nov. 6, 2019, which claims priority to German Patent Application No. DE 10 2018 219 006.2, filed on Nov. 7, 2018, the disclosures of which are hereby incorporated in their entirety by reference herein.

TECHNICAL FIELD

The present disclosure relates to a fan assembly for cooling an internal combustion engine of a motor vehicle.

BACKGROUND

The cooling system of an internal combustion engine, in particular of a motor vehicle, primarily discharges the heat that is dissipated on the combustion chamber or cylinder walls. Since excessively high temperatures would damage the engine, the internal combustion engine has to be cooled. Modern internal combustion engines, in particular four-cycle engines in motor vehicles, potentially with a few exceptions, are liquid cooled, wherein a mixture of water as well as anti-frost and anti-corrosion agents is typically used as a coolant for maintaining the operating temperature of the internal combustion engine as well as for operating an air-conditioning system.

SUMMARY

One or more objects of the present disclosure is a fan assembly (fan module) for a motor vehicle, such as for a hybrid vehicle which is driven by an internal combustion engine and by an electric motor. Furthermore, a method for operating such a fan assembly is to be specified, said method operating in an effective manner (effective in terms of output) in all operating ranges of the motor vehicle. The generation of noise of the fan assembly (of the fan module) is to be as low as possible such as during the charging operation of the battery of a provided electric-motor drive, that is to say that said fan assembly is to operate in an ideally silent manner.

To this end, the fan assembly for cooling an internal combustion engine of a motor vehicle, for example of a hybrid vehicle with an internal combustion engine and an electric motor supplied by a rechargeable battery, has a first and a second cooling fan. The first cooling fan is a radial fan which axially suctions the cooling air passing through a radiator, that is to say a heat exchanger which is passed through by a coolant flow, and upon deflection (deflection by 90°) radially expels said cooling air, that is to say expels (exhausts) said cooling air in the radial direction toward the outside. The second cooling fan is an axial fan which axially suctions the cooling air and axially expels said cooling air, that is to say expels (exhausts) said cooling air in the axial direction toward the outside.

"Axial" herein is understood to be a direction parallel to (coaxial with) the rotation axis (axial direction) of the axial fan and/or radial fan, and "radial" is understood to be a direction perpendicular (transverse) to the rotation axis (radial direction) of the axial fan or radial fan, respectively.

The rotation axes of the fans in turn run in the travel direction of the motor vehicle and are thus parallel to the travel direction.

The radiator, that is to say the heat exchanger which is passed by the coolant flow, in terms of the travel direction of the motor vehicle, that is to say in terms of the main direction of movement of said motor vehicle and in terms of the airstream generated on account thereof (airstream direction/airflow direction) has a front side and a rear side. The airstream which can be reinforced by means of the fan assembly impacts the radiator (heat exchanger) on the front side thereof, and upon passing through said radiator (heat exchanger) exits at the rear side. This leads to the coolant being cooled, and optionally to the internal combustion engine being additionally cooled.

According to one or more embodiments, a cooling fan module for cooling an internal combustion engine of a motor vehicle, for example of a hybrid vehicle with an internal combustion engine and the electric motor supplied by a rechargeable battery, having a first cooling fan which in an airflow direction is disposed behind a heat exchanger which is passed through by a coolant flow, and a second cooling fan, wherein the first cooling fan is a radial fan which axially suctions cooling air and radially expels cooling air, and wherein the second cooling fan is an axial fan which axially suctions cooling air and radially expels cooling air, the axial fan is disposed behind the heat exchanger so as to be laterally beside the radial fan in a plane which is parallel to the rear side of said heat exchanger.

According to another variant of the fan assembly for cooling an internal combustion engine of a motor vehicle, for example of a hybrid vehicle with an internal combustion engine and the electric motor supplied by a rechargeable battery, having a first cooling fan which in an airflow direction is disposed behind a heat exchanger which is passed through by a coolant flow, and a second cooling fan, wherein the first cooling fan is a radial fan which axially suctions cooling air and radially expels cooling air, and wherein the second cooling fan is an axial fan which axially suctions cooling air and radially expels cooling air, the axial fan in the airflow direction is disposed in front of the heat exchanger, preferably in a plane which is parallel to the front side of said heat exchanger.

In other words, the axial fan in the airflow direction of the cooling air is disposed behind the radiator or the heat exchanger, respectively, and hereby disposed in a plane which is parallel to the rear side of said radiator or heat exchanger, respectively, wherein the radial fan in this disposal of the axial fan is positioned in the plane which is parallel to the rear side of the heat exchanger (radiator) so as to be laterally beside the axial fan. Alternatively, the axial fan in the airflow direction is disposed in front of the heat exchanger (on the front side of the radiator), while the radial fan in turn is disposed behind the heat exchanger (on the rear side of the radiator). In both variants, the axial intake opening of the radial fan faces the radiator or the heat exchanger, respectively, that is to say the rear side of said radiator or heat exchanger, respectively.

A cooling module having an axial fan which in the travel direction (of the motor vehicle) is behind the radiator (thus on the rear side of the latter) and having a further fan is indeed known from DE 10 2004 028 697 A1. This here however is a crossflow fan having a functional principle which is fundamentally different from that of a radial fan. As opposed to the radial fan according to the present disclosure, the air in the crossflow fan is not suctioned in an axial but radial (or tangential) manner and, as opposed to the radial fan according to the present disclosure, the crossflow fan, upon deflecting the air by 90°, expels (exhausts) the air not in a radial but axial manner into the downstream radiator. Moreover, as opposed to according to the present disclosure, the crossflow fan in the known cooling module in the travel direction (of the vehicle) is disposed in front of the cooler (thus on the front side of the latter).

In one or more embodiments, the axial fan and the radial fan of the fan assembly according to the present disclosure are driven by an electric motor. For a particularly space-saving design of the axial fan and the radial fan, for example for an ideally small installation size of the cooling fans in the axial direction, the electric motors that serve for driving the fan wheels of said cooling fans are suitably disposed in a fan hub of a radial impeller of the radial fan and in a fan hub of an axial impeller of the axial fan.

As an example, when the axial fan and the radial fan are provided in the same plane behind the heat exchanger, the axial fan and the radial fan are advantageously disposed in a common fan frame. The rotation axis of the axial impeller of the axial fan and the rotation axis of the radial impeller of the radial fan hereby run so as to be parallel. If the radial fan and the axial fan are disposed behind one another with the radiator (heat exchanger) being disposed therebetween, the rotation axes of said radial fan and said axial fan expediently run so as to be coaxial.

By disposing the axial fan on the front side and the radial fan on the rear side of the radiator (heat exchanger), the area coverage (blockage) of the cooling area is minor in relation to a reversed order, specifically a disposal of the radial fan on the front side and the axial fan on the rear side of the radiator, since a sufficiently large area for a passing flow is provided by the axial fan even when only the radial fan is in operation, and the impeller of said axial fan can freely rotate without being driven, this further reducing drag.

In another embodiment, the latter is assigned a control device which is provided and specified for actuating the axial fan and the radial fan, or only the axial fan, or only the radial fan, so as to operate said axial fan and/or said radial fan as a function of the driving operation (driving cycle) or of the operating range of the motor vehicle. To this end, the electric motors of the axial impeller of the axial fan or of the radial impeller of the radial fan, respectively, which drive said axial impeller and said radial impeller, respectively, are correspondingly energized. The control device can be separate or else be integrated in the electric motors, such as by way of individual functional building blocks.

Expediently provided here is a threshold value of the vehicle speed, only the axial fan being operated above set threshold value, and only the radial fan being operated below set threshold value, such as during a charging operation of a battery for driving the motor vehicle by an electric motor. Operating only the radial fan at low vehicle speeds, and such as when said vehicle is stationary, and/or during the charging operation of the optionally present battery for driving a hybrid vehicle by an electric motor, is particularly advantageous because the radial fan is distinguished by a very low generation of noise, thus operates in a particularly silent manner. In the case of the radial fan driven by an electric motor, the ratio of (aerodynamic) cooling output and (electric) power consumption may be favorable during the charging operation, that is to say the radial fan operates in a particularly efficient manner.

At a higher, high and/or a maximum vehicle speed, that is to say during rapid travel or at a high load of the internal combustion engine, for example when travelling uphill and/or in the case of an additional stress by virtue of a trailer towed by the vehicle, the operation of the axial fan as well as the radial fan (dual operation of the fan assembly) is particularly suitable. The axial fan here can be conceived so as to be comparatively small (of a small construction with small dimensions), or so as to have a comparatively low output and may be optimized in terms of a characteristic curve. Moreover, the axial fan can be conceived with a view to only one (single) aerodynamic operating point to be met.

In the method for operating such a fan assembly, the axial fan and the radial fan are operated conjointly or individually as a function of the operating range, of the load on the internal combustion engine, of the respective driving cycle and/or of the speed of the motor vehicle. According to one advantageous refinement here, the axial fan and the radial fan can be operated above a threshold value of the speed of the motor vehicle, for example during rapid travel, and only the axial fan or only the radial fan can be operated below the threshold value, for example during slow travel of the vehicle, for example when the vehicle is stationary and/or during a charging operation of a battery of a hybrid vehicle in which the vehicle is driven by internal combustion engine and electric motor.

A number of advantages may be achieved by the present disclosure that, by providing a fan assembly having an axial fan and having a radial fan, practically all driving situations and operating ranges of a motor vehicle can be covered while providing a volumetric flow of the cooling air which is sufficient for reliable cooling. The axial fan and the radial fan here can operate in the range of the respective optimum efficiency of said fans at a simultaneously low noise emission, such as at a low vehicle speed. A combined operation using the axial fan and using the radial fan is suitable in the case of high-temperature requirements. A high degree of efficiency and, on account thereof, better cooling or improved exhaust emission values, respectively, are achieved by suitable shutting off or blocking in combination with different radiators.

In the case of a hybrid vehicle, the driving operation using only the axial fan is suitable, or at high-temperature requirements the driving operation using said axial fan and the radial fan is suitable, and in the case of a stationary vehicle, and such as in the battery-charging state, the operation of only the radial fan is suitable because the latter in this instance operates in an efficient and very silent manner.

BRIEF DESCRIPTION OF THE DRAWINGS

Exemplary embodiments of the invention will be explained in more detail below by means of a drawing in which.

DETAILED DESCRIPTION

Figure 1:
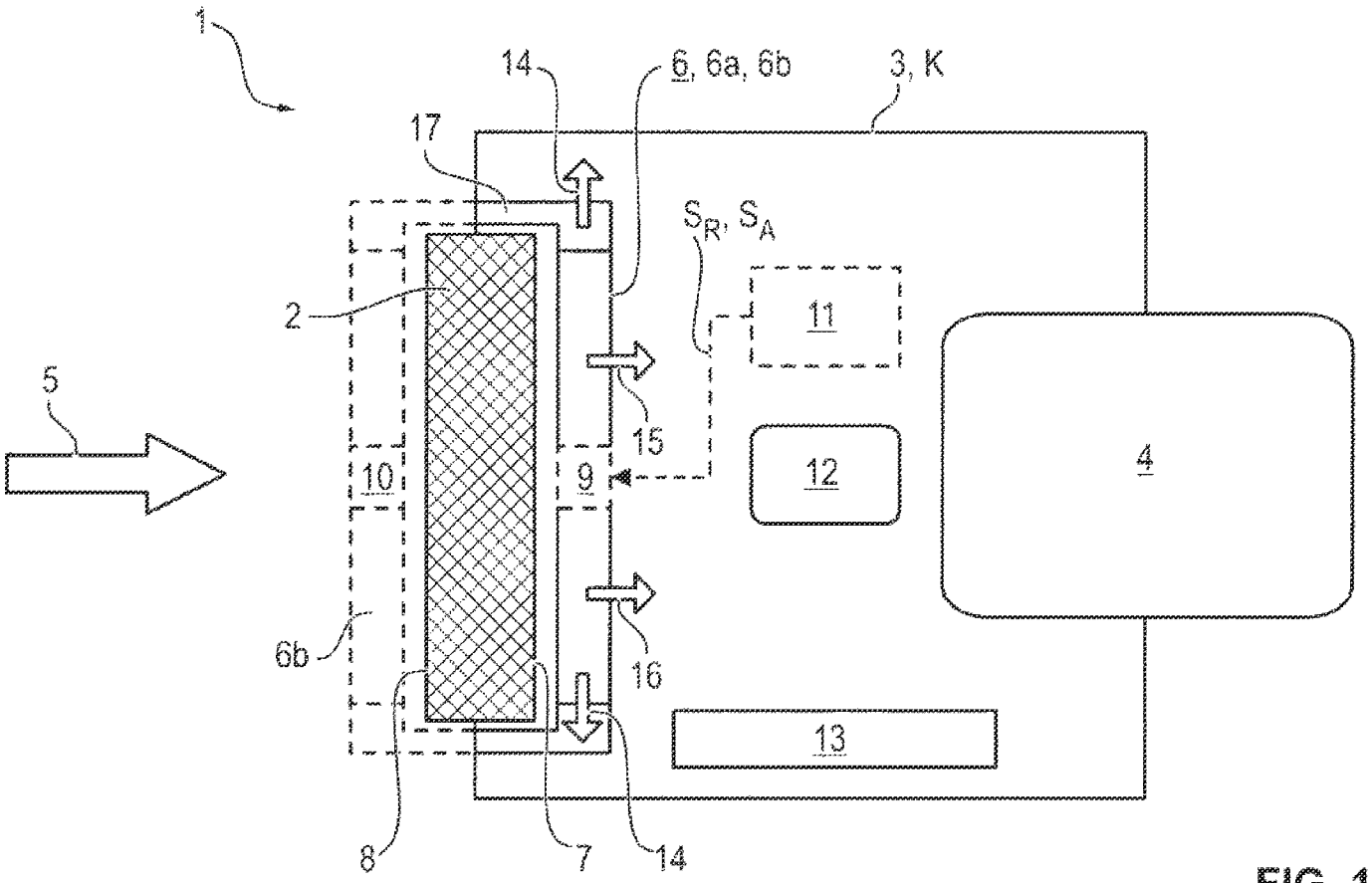
FIG. 1 in a schematically simplified manner shows a cooling fan having a fan assembly with a radial and an axial fan.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Equivalent parts are provided with the same reference signs in all figures.

The coolant which is directed in pipes that are incorporated in the radiator block of a radiator has in turn to be cooled, to which end cooling air flows across cooling ribs which act as a heat exchanger for the coolant. Since the airstream which serves as cooling air is usually insufficient for cooling, such as at low speeds of the motor vehicle, it is known, for example from DE 10 2013 006 499 U1, to dispose an axial fan within a radiator frame on the radiator that comprises the cooling ribs. The axial fan which may be driven by an electric motor generates an additional airflow, whereby the radiator frame has a number of dynamic pressure flap openings which can be closed by dynamic pressure flaps. In the case of opened dynamic pressure flaps and comparatively high vehicle speeds, a reduced coverage of the cooling area as well as a large area that can be freely passed through by a flow, and thus an increased cooling output, is enabled by virtue of a minor blockage.

The fan in the travel direction is typically disposed behind the radiator block of the radiator (heat exchanger). The air is suctioned through the radiator block with the aid of a fan wheel of the fan and directed onto the internal combustion engine. Should there also be a condenser block of a condenser of an air-conditioning system present in addition to the radiator block, the condenser block in the direction of the airstream (airflow direction) is usually disposed in front of the radiator block. The fan wheel of the fan is disposed in a circular clearance of the frame body of the fan frame, the air being directed through the radiator block by means of said circular clearance, whereby the frame body covers the radiator block in a substantially complete manner.

In order to achieve a high degree of efficiency of the fan, the frame body, with the exception of the circular clearance, is embodied so as to be substantially airtight. In this way, the pressure differential between the region in front of the radiator block and the region behind the frame body, in each case viewed in the travel direction of the vehicle, is comparatively large. In the case of a stationary vehicle, a comparatively large quantity of air is thus suctioned through the radiator block of the radiator by means of the axial fan. As soon as the motor vehicle is moved at a comparatively high speed, the airstream is held back by the frame body and the radiator block. Consequently, only a specific proportion of the airstream passes through the radiator block.

In order for this issue to be alleviated, the dynamic pressure flap openings which are in each case able to be closed by a dynamic pressure flap are incorporated in the frame body. When the fan is operated while the vehicle is stationary, the dynamic pressure flap openings are closed by means of the dynamic pressure flaps, this requiring a comparatively large pressure differential between the region in front of and behind the fan frame. As soon as the dynamic pressure flaps are impinged by an airstream, thus as soon as the motor vehicle is moved, the dynamic pressure flaps pivot to an opened state and the airstream, in addition to the clearance for the fan wheel, also flows through the dynamic pressure flap openings. The volume of air flowing through the radiator block is increased in this way.

A lateral illustration of a radiator or cooling fan system 1 of a motor vehicle (not visualized in more detail) is schematically illustrated in FIG. 1. The cooling fan system 1 comprises a heat exchanger which hereunder is referred to as radiator 2 and on which cooling pipes or cooling hoses 3 are guided. A coolant (a cooling liquid) K is situated within the cooling pipes 3, said coolant/cooling liquid K being kept in circulation by means of a pump (not illustrated). The coolant K is directed through an internal combustion engine (combustion engine) 4 and heated by the latter, whereby the internal combustion engine 4 is cooled. The heated coolant K is again directed through the radiator 2, the latter being impinged by an airstream. The direction of the airstream here is along an airstream direction which corresponds substantially to the main direction of propulsion of the motor vehicle and hereunder is referred to as the airflow direction 5.

The airstream is reinforced by means of a fan assembly 6, or in the case of a stationary motor vehicle generated by said fan assembly 6. The fan assembly 6 comprises a radial fan 6*a* and an axial fan 6*b*. The radial fan 6*a* and the axial fan 6*b* in one or more embodiments are disposed on the rear side 7 of the radiator 2, and there are situated beside one another in a plane which is parallel to the rear side 7 of the radiator 2, that is to say so as to be behind one another perpendicular to the drawing plane of FIG. 1.

According to one alternative, the radial fan 6*a* in the airflow direction 5 is disposed behind the radiator 2 and thus again on the rear side 7 of the latter, while the axial fan 6*b* in the airflow direction 5 is disposed in front of the radiator 2 and there in turn disposed in a plane which is parallel to the front side 8 of said radiator 2. The radial fan 6*a* and the axial fan 6*b* are in each case driven by an electric motor 9 and 10, thus driven by electric motors.

A control device 11 sets the operation of the radial fan 6*a* and axial fan 6*b*. This means that the control installation 11 by way of corresponding control signals SR, SA sets in operation the radial fan 6*a* or the axial fan 6*b*, or the radial fan 6*a* as well as the axial fan 6*b*. This takes place as a function of the travel situation, the respective operating range, the operating load (for example in uphill travel and/or when driving with a trailer) and as a function of the speed of the vehicle. At a high or maximum vehicle speed (rapid travel) and/or at a particularly high temperature load (high-temperature requirement), the radial fan 6*a* as well as the axial fan 6*b* are thus suitably actuated for operation. To this end, the respective electric motor 9, 10 of said radial fan 6*a* and said axial fan 6*b* are correspondingly energized.

At a comparatively low vehicle speed, only the axial fan 6*b* can be operated, for example. During slow travel and when the vehicle is stationary, the operation of only the radial fan 6*a* may be suitable because the latter operates in an efficient and very silent manner.

In the case of a hybrid vehicle with a further propulsion machine in the form of the electric motor 12 in addition to the internal combustion engine 4, the operation of only the radial fan 6*a* may be required during a charging procedure of a battery 13 which then supplies the electric current required for operating the electric motor 12.

As an example, the operating mode of the fan assembly 6 is of such a type that only the axial fan 6*b*, or the latter and the radial fan 6*a*, are operated during the travel of the vehicle, while only the radial fan 6*a* is operated during a stoppage of the vehicle and/or a charging operation of the battery 13 for supplying the electric motor 12.

The radial fan 6*a* suctions the cooling air L by way of the radiator 2, deflects said cooling air by 90°, and radially expels (exhausts) the deflected cooling air L. This is visualized by the flow arrows 14. The axial fan 6*b* axially suctions the cooling air L and also axially expels (exhausts) said cooling air L. This is visualized by the flow arrows 15, 16.

As an example, in the embodiment having the radial fan 6*a* and the axial fan 6*b* disposed beside one another on the rear side 7 of the radiator 2, said radial fan 6*a* and said axial fan 6*b* are suitably disposed on a common fan frame 17. A suitable dual fan module having a radial fan 6*a* and an axial fan 6*b* can be provided in this way.

In the embodiment having the axial fan 6*b* and the radial fan 6*a* disposed behind one another in the airflow direction 5, a common radiator frame can likewise be provided. Said common radiator frame in this instance is constructed in such a manner that, in the case of an assembled radiator 2, the axial fan 6*b* is positioned on the front side 8 of said radiator 2, and the radial fan 6*a* is positioned on the rear side 7 of said radiator 2.

Figure 2:
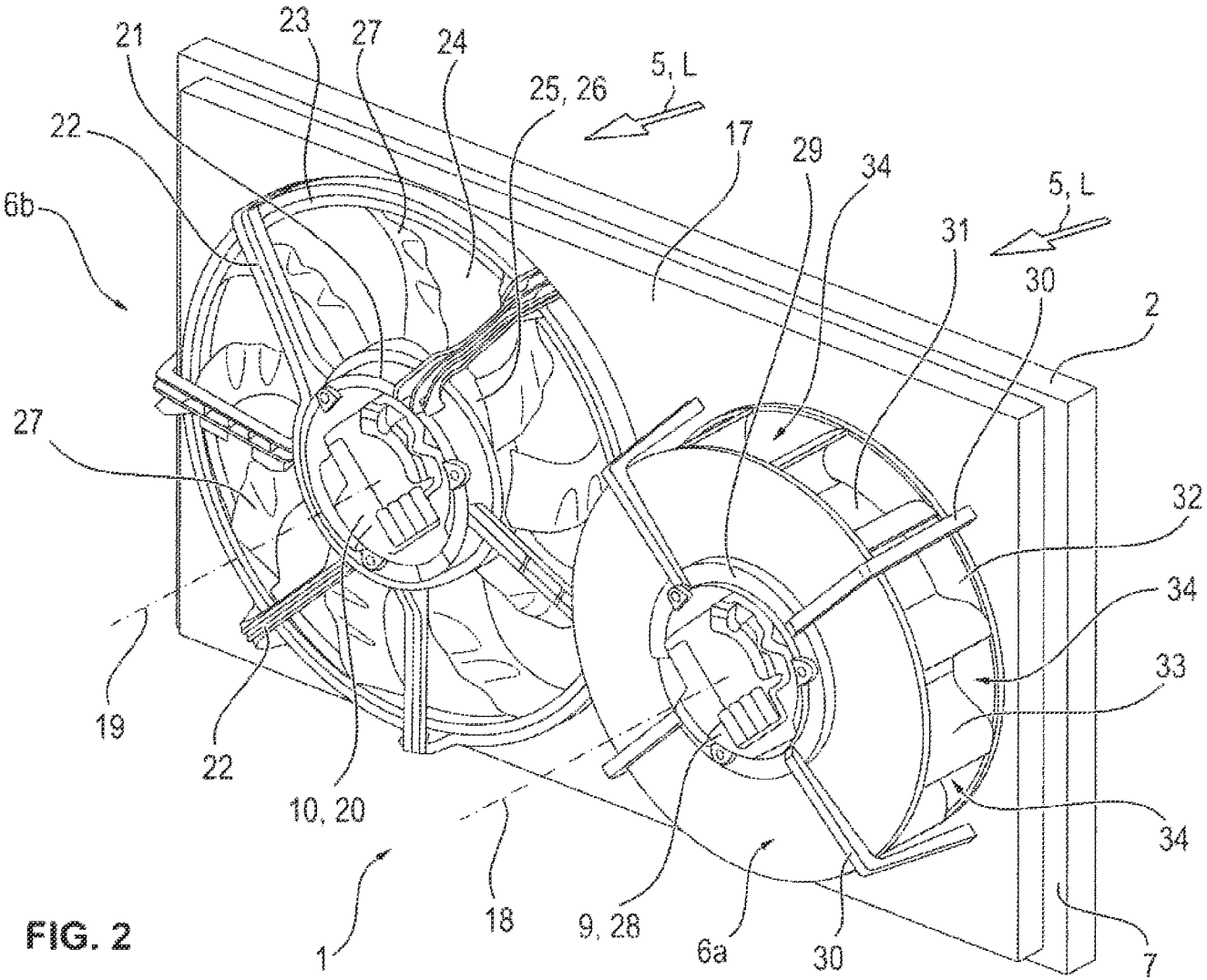
FIG. 2 in a perspective view shows the fan assembly according to a first variant, having the radial fan and the axial fan on the rear side of a radiator.

FIG. 2 shows the fan assembly 6 having a radial fan 6*a* and an axial fan 6*b* which are disposed beside one another in the common fan frame 17 so as to be in a plane parallel to the rear side 7 of the radiator 2. The mutually parallel rotation axes of the radial fan 6*a* and of the axial fan 6*b* are identified by the reference signs 18 and 19, respectively. The electric motor 10 of the axial fan 6*b* can be seen when viewed toward a motor electronics system 20. The electric motor 10 is disposed in a central, stationary hub 21 having substantially radial support stays 22 which in the region of an opening periphery 23 of a throughflow opening 24 are connected to the fan frame 17. The axial fan 6*b* in the region of the hub 21 or of the motor electronics system 20, respectively, can be provided with a cover.

A wheel hub 25 of an axial impeller 26 of the axial fan 6*b* is aligned with the central, stationary hub 21. Proceeding from the external circumference of the wheel hub 25, a number of blades or vanes 27 which are disposed so as to be circumferentially distributed extend in a crescent-shaped and substantially radial manner. By virtue of the electric motor 10 being disposed in the region of the hubs 21 and 25, the axial installation size or installation depth of the axial fan 6*b* in the direction of the rotation axis 19 thereof is particularly minor.

The radial fan 6*b*, which on the rear side is or may be provided with a housing cover (not shown), has a motor electronics system 28 (on the rear side). The electric motor 9 and the motor electronics system 28 thereof are in turn disposed in a central, stationary hub 29 having substantially radial support stays 30 which are connected to the fan frame 17. An axial intake opening 31 of the radial fan 6*a* that is directed toward the rear side 7 of the radiator 2 can be seen in FIG. 2. The electric motor 9 drives a radial impeller 32 having a number of blades or vanes 33 of the radial fan 6*a*. In order to achieve an ideally minor axial installation size, the electric motor 9 is at least partially, such as at the side proximal to the rotor, that is to say when said electric motor 9 is embodied as external-rotor motor by way of the rotor of said electric motor 9, situated in a wheel hub of the radial impeller 32. The blades or vanes 33 of the radial impeller 32 extend axially in the direction of the rotation axis 18 and circumferentially form an outflow opening 34. The cooling air L which has been axially suctioned, upon being deflected by 90°, flows out radially by way of the outflow opening 32 of the radial fan 6*a*.

Figure 3:
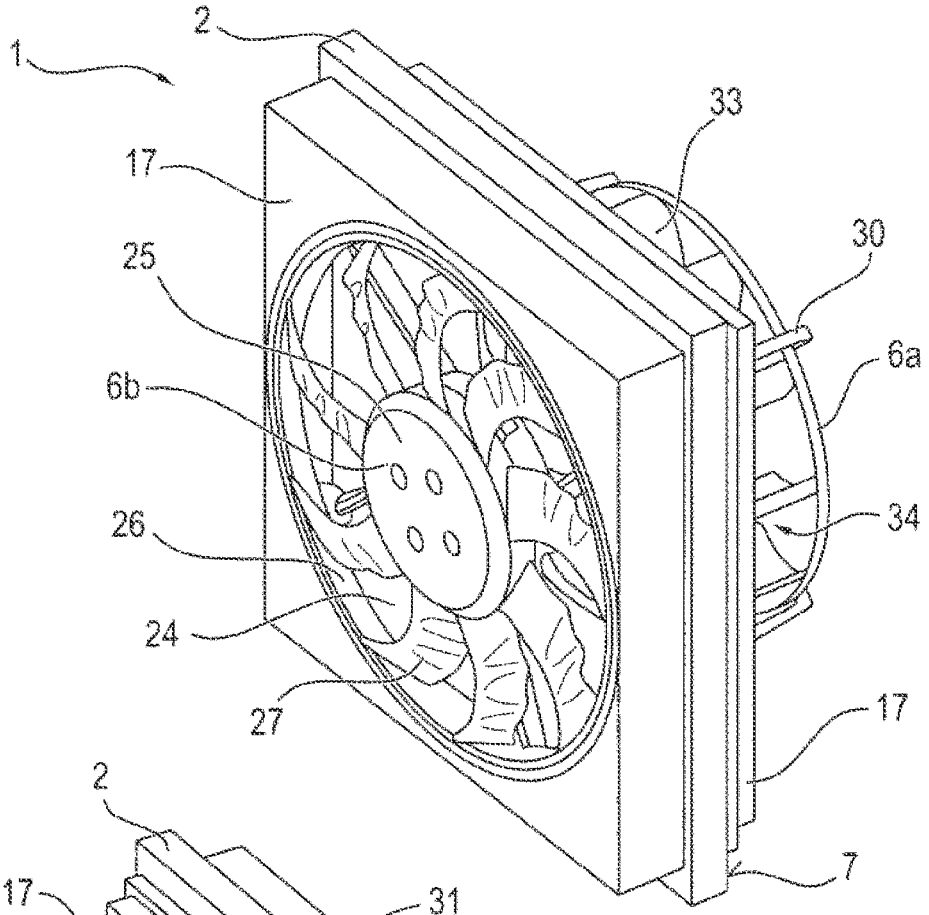
FIG. 3 in a perspective view shows the fan assembly according to a second variant, having a radial fan on the rear side and an axial fan on the front side of a radiator, viewed toward the axial fan.
Figure 4:
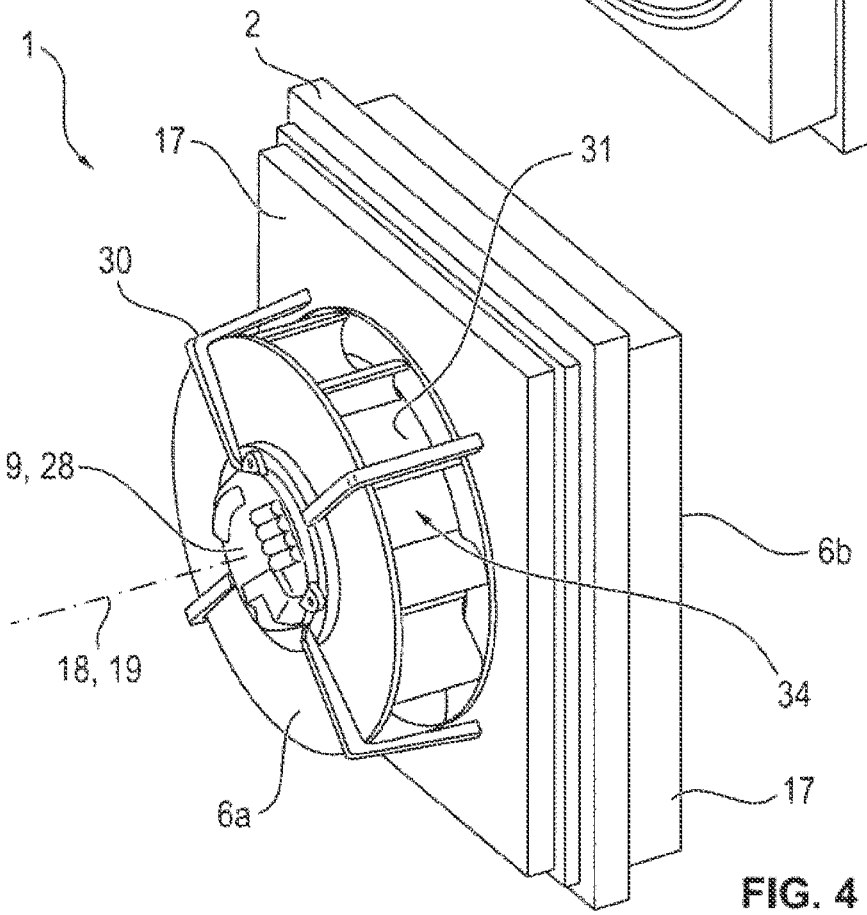
FIG. 4 in a perspective illustration shows the fan assembly according to the second variant, viewed toward the radial fan.

FIGS. 3 and 4 show the disposal of the radial fan 6*a* and of the axial fan 6*b* so as to be axially behind one another, wherein the radial fan 6*a* is disposed in a plane which is parallel to the rear side 7, and the axial fan 6*b* is disposed in a plane which is parallel to the front side 8 of the radiator 2. In the exemplary embodiment, the rotation axes 18, 19 of the radial fan 6*a* and of the axial fan 6*b*, respectively, run so as to be coaxial (in the same axis). The construction of the radial fan 6*a* and of the axial fan 6*b* in the embodiment according to FIGS. 3 and 4 is otherwise identical to that of the embodiment according to FIG. 2.

The motor electronics system 20, 28 of the electric motors 9, 10 of the radial fan 6*a* or of the axial fan 6*b*, respectively, may contain functional building blocks of the control device 11. The control device 11 can also be completely integrated in the motor electronics system 20, 28 of the axial fan 6*b* and/or the radial fan 6*a*, respectively. The control signals SR and SA can thus be generated by the respective motor electronics system 20, 28. The electric motors 9, 10 of the two fans 6*a*, 6*b* in this instance are connected to the on-board vehicle electric system only by way of supply lines.

The claimed invention is not restricted to the exemplary embodiments described above. Rather, it is also possible for other variants of the invention to be derived therefrom in the scope of the disclosed claims by a person skilled in the art without departing from the subject matter of the claimed invention. As an example, it is also the case that all individual features in the scope of the disclosed claims described in conjunction with the various exemplary embodiments may also be combined with one another in some other way without departing from the subject matter of the claimed invention.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE SIGNS

1 Radiator system/cooling fan system
2 Radiator/heat exchanger
3 Cooling pipe/cooling hose
4 Internal combustion engine
5 Airstream direction/airflow direction
6 Fan assembly
6*a* Radial fan
6*b* Axial fan
7 Rear side
8 Front side
9,10 Electric motor
11 Control device
12 Electric motor/Drive
13 Battery
14 Radial flow arrow
16 Axial flow arrow
17 Fan frame
18,19 Rotation axis
20 Motor electronics system
21 Hub
22 Stay
23 Opening periphery
24 Throughflow opening
25 Wheel hub
26 Axial impeller

27 Blade/vane
28 Motor electronics system
29 Hub
30 Support stay
31 Intake opening
32 Radial fan wheel
33 Blade/Vane
34 Outflow opening
K Coolant
L Cooling air
$S_{A,R}$ Control signal While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A fan assembly configured to cool an internal combustion engine of a motor vehicle provided with an internal combustion engine, a heat exchanger, and an electric motor supplied by a rechargeable battery, the fan assembly comprising:

a first cooling fan disposed behind a heat exchanger, with respect to an airflow direction of cooling air passing through the heat exchanger, wherein the first cooling fan is a radial fan configured to axially suction and radially expel the cooling air; and a second cooling fan, wherein the second cooling fan is an axial fan configured to axially suction and axially expel the cooling air, and wherein the axial fan is disposed behind the heat exchanger and laterally adjacent to the radial fan with respect to a plane parallel to a rear side of said heat exchanger.

2. The fan assembly of claim 1, further comprising:

an electric motor configured to drive the axial fan and the radial fan.

3. The fan assembly of claim 1, further comprising:

a fan frame, wherein the axial fan and the radial fan are in a common plane and are each disposed in the fan frame.

4. The fan assembly of claim 1, further comprising:

a control device configured to command the axial fan and/or the radial fan to operate based on a driving operation or an operating range of the motor vehicle.

5. The fan assembly of claim 4, wherein the control device is further configured to, in response to motor vehicle speed exceeding a threshold, command the axial fan and the radial fan to operate.

6. The fan assembly of claim 5, wherein the control device is further configured to, responsive to motor vehicle speed exceeding the speed threshold, operating the axial fan and the radial fan above a threshold value.

7. The fan assembly of claim 6, wherein the control device is further configured to, responsive to motor vehicle speed falling below the speed threshold, operating the radial fan below a threshold value.

8. The fan assembly of claim 6, wherein the threshold value is based on a volume of cooling air expelled by the radial fan.

9. A method for operating a fan assembly of claim 1, the method comprising:

in response to motor vehicle speed exceeding a speed threshold, operating the axial fan and the radial fan simultaneously; and in response to an operating range of the vehicle, operating either the axial fan or the radial fan.

10. The method of claim 9, further comprising:

in response to the motor vehicle being stationary, only operating radial fan.

11. The method of claim 10, wherein the operating step includes operating the radial fan below a radial fan threshold.

12. The method of claim 9, further comprising:

in response to charging the battery, only operating the radial fan.

13. The fan assembly of claim 1, wherein the axial fan is disposed in front of the heat exchanger, with respect to the airflow direction, and in a plane parallel to a front side of the heat exchanger.

14. A cooling fan assembly for use in a motor vehicle, the cooling fan assembly comprising:

a fan frame a first side and a second side each arranged with respect to an airflow direction;

a radial fan disposed on the first side of the fan frame and configured to axially suction and radially expel cooling air; and an axial fan disposed adjacent to the radial fan on the first side of the fan frame, wherein the axial fan is configured to axially suction and radially expel the cooling air.

15. The cooling fan assembly of claim 14, further comprising:

an electric motor configured to drive the axial fan and the radial fan; and a controller configured to command the electric motor to drive the axial fan and the radial fan.

16. The cooling fan assembly of claim 15, wherein the controller is further configured to, responsive to motor vehicle speed exceeding a speed threshold, command the electric motor to drive the axial fan and the radial fan at the same time.

17. The cooling fan assembly of claim 15, wherein the motor vehicle is a hybrid vehicle including an internal combustion engine, a battery, and a motor powered by the battery and the controller is further configured to, responsive to charging the battery, operate the radial fan and power off the axial fan.

18. The cooling fan assembly of claim 15, wherein the controller is further configured to, responsive to the motor vehicle being stationary, operate the radial fan and power off the axial fan.

19. The cooling fan assembly of claim 15, wherein the radial fan and the axial fan are disposed in a common plane.

20. The cooling fan assembly of claim 15, wherein the controller is further configured to, responsive to motor vehicle operating load exceeding a threshold, command the electric motor to drive the axial fan and the radial fan at the same time.

* * * * *